US006506104B2

(12) United States Patent
Perlov et al.

(10) Patent No.: US 6,506,104 B2
(45) **Date of Patent: *Jan. 14, 2003**

(54) CARRIER HEAD WITH A FLEXIBLE MEMBRANE

(75) Inventors: Ilya Perlov, Santa Clara, CA (US); Eugene Gantvarg, Santa Clara, CA (US); Sen-Hou Ko, Cupertino, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/908,868

(22) Filed: Jul. 18, 2001

(65) Prior Publication Data

US 2001/0041526 A1 Nov. 15, 2001

Related U.S. Application Data

(60) Continuation of application No. 09/611,246, filed on Jul. 7, 2000, now Pat. No. 6,277,010, which is a division of application No. 09/368,396, filed on Aug. 4, 1999, now Pat. No. 6,106,378, which is a division of application No. 08/891,548, filed on Jul. 11, 1997, now Pat. No. 5,964,653.

(51) Int. Cl.[7] ..... B24B 29/00

(52) U.S. Cl. ..... 451/288; 451/41; 451/285; 451/286

(58) Field of Search ..... 451/288, 255, 451/286, 287, 289, 397, 398, 41

(56) References Cited

U.S. PATENT DOCUMENTS

| | | | |
|---|---|---|---|
| 4,194,324 A | 3/1980 | Bonora et al. | |
| 4,373,991 A | 2/1983 | Banks | |
| 4,918,869 A | 4/1990 | Kitta | |
| 5,081,795 A | 1/1992 | Tanaka et al. | |
| 5,193,316 A | 3/1993 | Olmstead | |

(List continued on next page.)

FOREIGN PATENT DOCUMENTS

| | | |
|---|---|---|
| DE | 86 31 087 | 4/1987 |
| EP | 0 156 746 A1 | 10/1985 |
| EP | 0 650 806 A1 | 5/1995 |
| EP | 0 653 270 A1 | 5/1995 |
| JP | 61-25768 | 2/1986 |
| JP | 63-114870 | 5/1988 |
| JP | 63-300858 | 12/1988 |
| JP | 2-243263 | 3/1989 |
| JP | 1-216768 | 8/1989 |
| JP | 2-224263 | 9/1990 |

*Primary Examiner*—Timothy V. Eley
*Assistant Examiner*—Dung Van Nguyen
(74) *Attorney, Agent, or Firm*—Fish & Richardson

(57) ABSTRACT

A carrier head with a flexible member connected to a base to define a first chamber, a second chamber and a third chamber. A lower surface of the flexible member provides a substrate receiving surface with an inner portion associated with the first chamber, a substantially annular middle portion surrounding the inner portion and associated with the second chamber, and a substantially annular outer portion surrounding the middle portion and associated with the third chamber. The width of the cuter portion may be significantly less than the width of the middle portion. The carrier head may also include a flange connected to a drive shaft and a gimbal pivotally connecting the flange to the base.

15 Claims, 7 Drawing Sheets

U.S. PATENT DOCUMENTS

| | | | | | |
|---|---|---|---|---|---|
| 5,205,082 | A | | 4/1993 | Shendon et al. | |
| 5,230,184 | A | | 7/1993 | Bukhman | |
| 5,377,451 | A | | 1/1995 | Leoni et al. | |
| 5,423,558 | A | | 6/1995 | Koeth et al. | |
| 5,423,716 | A | | 6/1995 | Strasbaugh | |
| 5,423,719 | A | | 6/1995 | Strasbaugh | |
| 5,441,444 | A | | 8/1995 | Nakajima | |
| 5,443,416 | A | | 8/1995 | Volodarsky et al. | |
| 5,476,414 | A | | 12/1995 | Hirose et al. | |
| 5,498,199 | A | | 3/1996 | Karlsrud et al. | |
| 5,584,751 | A | | 12/1996 | Kobayashi et al. | |
| 5,624,299 | A | | 4/1997 | Shendon | |
| 5,643,053 | A | | 7/1997 | Shendon | |
| 5,643,061 | A | | 7/1997 | Jackson et al. | |
| 5,651,724 | A | | 7/1997 | Kimura et al. | |
| 5,681,215 | A | | 10/1997 | Sherwood et al. | |
| 5,716,258 | A | | 2/1998 | Metcalf | |
| 5,716,264 | A | | 2/1998 | Kimura et al. | |
| 5,762,539 | A | | 6/1998 | Nakashiba et al. | |
| 5,762,544 | A | | 6/1998 | Zuniga et al. | |
| 5,795,215 | A | | 8/1998 | Guthrie et al. | |
| 5,797,789 | A | | 8/1998 | Tanaka et al. | |
| 5,803,799 | A | * | 9/1998 | Volodarsky et al. | 451/288 |
| 5,839,947 | A | | 11/1998 | Kimura et al. | |
| 5,851,140 | A | * | 12/1998 | Barns et al. | 451/288 |
| 5,876,272 | A | | 3/1999 | Inaba et al. | |
| 5,941,758 | A | | 8/1999 | Mack | |
| 5,964,653 | A | * | 10/1999 | Perlov et al. | 451/288 |
| 5,985,094 | A | | 11/1999 | Mosca | |
| 5,989,104 | A | | 11/1999 | Kim et al. | |
| 6,106,378 | A | | 8/2000 | Perlov et al. | |
| 6,152,808 | A | * | 11/2000 | Moore | 451/60 |
| 6,277,010 | B1 | | 8/2001 | Perlov et al. | |
| 6,283,834 | B1 | * | 9/2001 | Liauzu | 451/41 |

* cited by examiner

CARRIER HEAD WITH A FLEXIBLE MEMBRANE

This application is a continuation of U.S. application Ser. No. 09/611,246, filed Jul. 7, 2000, now U.S. Pat. No. 6,277,010 which is a divisional of U.S. application Ser. No. 09/368,396, filed Aug. 4, 1999, now U.S. Pat. No. 6,106,378, which is a divisional of U.S. application Ser. No. 08/891,548, filed Jul. 11, 1997, now U.S. Pat. No. 5,964,653.

BACKGROUND OF THE INVENTION

The present invention relates generally to chemical mechanical polishing of substrates, and more particularly to a carrier head for a chemical mechanical polishing system.

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes increasingly non-planar. This non-planar outer surface presents a problem for the integrated circuit manufacturer. If the outer surface of the substrate is non-planar, then a photoresist layer placed thereon is also non-planar. A photoresist layer is typically patterned by a photolithographic apparatus that focuses a light image onto the photoresist. If the outer surface of the substrate is sufficiently non-planar, then the maximum height difference between the peaks and valleys of the outer surface may exceed the depth of focus of the imaging apparatus, and it will be impossible to properly focus the light image onto the outer substrate surface.

It may be prohibitively expensive to design new photolithographic devices having an improved depth of focus. In addition, as the feature size used in integrated circuits becomes smaller, shorter wavelengths of light must be used, resulting in a further reduction of the available depth of focus. Therefore, there is a need to periodically planarize the substrate surface to provide a substantially planar layer surface.

Chemical mechanical polishing (CMP) is one accepted method of planarization. This planarization method typically requires that the substrate be mounted to a carrier or polishing head. The exposed surface of the substrate is then placed against a rotating polishing pad. The carrier provides a controllable load, i.e., pressure, on the substrate to press it against the polishing pad. In addition, the carrier may rotate to provide additional motion between the substrate and polishing pad. A polishing slurry, including an abrasive and at least one chemically-reactive agent, may be distributed over the polishing pad to provide an abrasive chemical solution at the interface between the pad and substrate.

A CMP process is fairly complex, and differs from simple wet sanding. In a CMP process, the reactive agent in the slurry reacts with the outer surface of the substrate to form reactive sites. The interaction of the polishing pad and the abrasive particles with the reactive sites results in polishing.

An effective CMP process should have a high polishing rate and generate a substrate surface that is finished (lacks small-scale roughness) and flat (lacks large-scale topography). The polishing rate, finish and flatness are determined by the pad and slurry combination, the relative speed between the substrate and pad, and the force pressing the substrate against the pad. Because inadequate flatness and finish can create defective substrates, the selection of a polishing pad and slurry combination is usually dictated by the required finish and flatness. Given these constraints, the polishing rate sets the maximum throughput of the polishing apparatus.

The polishing rate depends upon the force with which the substrate is pressed against the pad. Specifically, the greater this force, the higher the polishing rate. If the carrier head applies a non-uniform lad, i.e., if the carrier head applies more force to one region of the substrate than to another, then the high pressure regions will be polished faster than the low pressure regions. Therefore, a non-uniform load may result in non-uniform polishing of the substrate.

One problem that has been encountered in CMP is that the edge of the substrate is often polished at a different rate (usually faster, but occasionally slower) than the center of the substrate. This problem, termed the "edge effect", may occur even if the load is uniformly applied to the substrate. The edge effect typically occurs in the perimeter portion, e.g., the outermost five to ten millimeters, of the substrate. The edge effect reduces the overall flatness of the substrate, makes the perimeter portion of the substrate unsuitable for use in integrated circuits, and decreases yield.

Therefore, there is a need for a CMP apparatus that optimizes polishing throughput while providing the desired flatness and finish. Specifically, the CMP apparatus should have a carrier head which provides substantially uniform polishing of a substrate.

SUMMARY OF THE INVENTION

In one aspect, the invention is directed to a carrier head for use in a chemical mechanical polishing system. The carrier head comprises a base and a flexible member connected to the base to define a first chamber, a second chamber and a third chamber. A lower surface of the flexible member provides a substrate receiving surface with inner portion associated with the first chamber, a substantially annular middle portion surrounding the inner portion and associated with the second chamber, and a substantially annular outer portion surrounding the middle portion and associated with the third chamber. Pressures on the inner, middle and outer portions of the flexible member are independently controllable.

Implementations of the invention may include the following. The width of the outer portion may be significantly less than the width of the middle portion. The outer portion may have an outer radius approximately equal to or greater than 100 mm, such as 150 mm, and the width of the outer portion may be between about 4 and 20 mm, such as 10 mm. The flexible member may include an inner annular flap, a middle annular flap, and an outer annular flap, each flap being secured to a lower surface of the base to define the first, second and third chambers.

In another aspect, the carrier head comprises a flange attachable to a drive shaft, a base, a gimbal pivotally connecting the flange to the base, and a flexible member connected to the base and defining a chamber. A lower surface of the flexible member provides a substrate receiving surface. The gimbal includes an inner race connected to the base, an outer race connected to the flange to define a gap therebetween, and a plurality of bearings located in the gap.

Implementations of the invention may include the following. A spring may urge the inner race and outer race into contact with the bearings, and an annular retainer may hold the bearings. A plurality of pins may extends vertically through a passage in the flange portion such that an upper end of each pin is received in a recess in the drive shaft and a lower end of each pin is received in a recess in the base portion to transfer torque from the drive shaft to the base. A retaining ring may be connected to the base to define, in conjunction with the substrate receiving surface, a substrate receiving recess.

In another aspect, the invention is directed to an assembly for use in a chemical mechanical polishing system. The assembly comprises drive shaft, a coupling slidably connected to the drive shaft, a carrier head secured to a lower end of the drive shaft to rotate with the drive shaft, a vertical actuator coupled to an upper end of the drive shaft to control the vertical position of the drive shaft and the carrier head, and a motor coupled to the coupling ts rotate the coupling to transfer torque to the drive shaft.

Implementations of the invention may include the following. The drive shaft may extend through a drive shaft housing, and the vertical actuator and the motor may be secured to the drive shaft housing. The coupling may include an upper rotary ring surrounding the upper end of the drive shaft and a lower rotary ring surrounding the lower end of the drive shaft, a first bearing rotatably connecting the upper rotary ring to the drive shaft housing and a second bearing rotatably connecting the lower rotary ring to the drive shaft housing. The upper and lower rotary rings may be spline nuts and the drive shaft may be a spline shaft.

In another aspect, the invention is directed to a carrier head assembly for use in a chemical mechanical polishing system, comprising a drive shaft a first ball bearing assembly laterally securing an upper end of the drive shaft, a second ball bearing assembly laterally securing a lower end of the drive shaft, and a carrier head connected to the lower end of the drive shaft by a gimbal. The gimbal permits the carrier head to pivot with respect to the drive shaft. The distance between the first ball bearing assembly and the second ball bearing assembly is sufficient to substantially prevent lateral forces transferred through the gimbal from pivoting the drive shaft.

In another aspect, the carrier head assembly comprises a drive shaft and a carrier head connected to a lower end of the drive shaft. The drive shaft includes a bore and at least one cylindrical tube positioned in the bore to define a central passageway and at least one annular passageway surrounding the central passageway. The carrier head includes a plurality of chambers, each chamber connected to one of the passageways.

Implementations of the invention may include the following. The draft shaft may include two concentric tubes positioned in the bore to define three concentric passageways, each of the passageways connected to one of the chambers. A rotary union may couple a plurality of pressure sources to respective ones of the plurality passageways.

In another aspect, the invention is directed to a carrier head comprising first, second and third independently pressurizable chambers, a flexible inner member associated with the first chamber to apply a first pressure to a central portion of a substrate, a substantially annular flexible middle member associated with the second chamber and surrounding the inner member to apply a second pressure to a middle portion of the substrate, and a substantially annular flexible outer member associated with the third chamber and surrounding the middle member to apply a third pressure to an outer portion of the substrate. The outer member is substantially narrower than the middle member.

Advantages of the invention include the following. The carrier head applies a controllable load to different portions of the substrate to improve polishing uniformly. The carrier head is able to vacuum-chuck the substrate to lift it off the polishing pad. The carrier head contains few moving parts, and it is small and easy to service.

Other advantages and features of the present invention will become apparent from the following description, including the drawings and claims.

DESCRIPTION OF THE PREFERRED EMBODIMENT(S)

Figure 1:
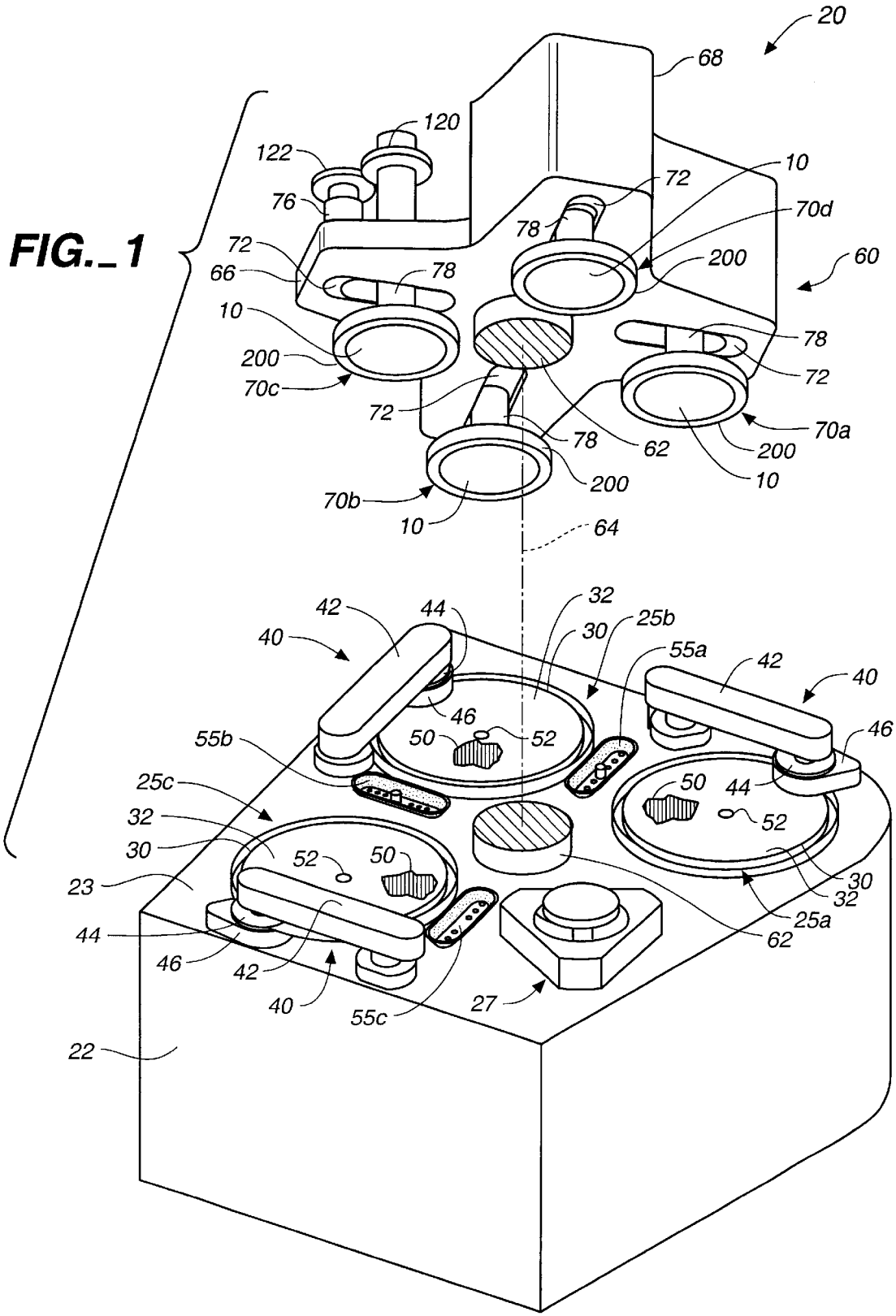
FIG. 1 is a schematic exploded perspective view of a chemical mechanical polishing apparatus.

Referring to FIG. 1, one or more substrates 10 will be polished by a chemical mechanical polishing (CMP) apparatus 20. A complete description of CMP apparatus 20 may be found in U.S. patent application Ser. No. 08/549,336, by Perlov, et al., filed Oct. 27, 1996, entitled CONTINUOUS PROCESSING SYSTEM FOR CHEMICAL MECHANICAL POLISHING, and assigned to the assignee of the present invention, the entire disclosure of which is hereby incorporated by reference.

The CMP apparatus 20 includes a lower machine base 22 with a table top 23 mounted thereon and a removable upper outer cover (not shown). The table top 23 supports a series of polishing stations 25*a,* 25*b* and 25*c,* and a transfer station 27. The transfer station 27 forms a generally square arrangement with the three polishing stations 25*a,* 25*b* and 25*c*. The transfer station 27 serves multiple functions of receiving the individual substrates 10 from a loading apparatus (not shown), washing the substrates, loading the substrates into carrier heads (to be described below), receiving the substrates from the carrier heads, washing the substrates again, and finally transferring the substrates back to the loading apparatus.

Each polishing station 25*a*–25*c* includes a rotatable platen 30 on which is placed a polishing pad 32. If the substrate 10 is an eight-inch (200 mm) diameter disk, then the platen 30 and the polishing pad 32 will be about twenty inches in diameter. The platen 30 may be a rotatable aluminum or stainless steel plate connected by a stainless steel platen drive shaft (not shown) to a platen drive motor (also not shown). For most polishing processes, the drive motor rotates the platen 30 at about thirty to two-hundred revolutions per minute, although lower or higher rotational speeds may be used.

The polishing pad 32 may be a composite material with a roughened polishing surface. The polishing pad 32 may be attached to the platen 30 by a pressure-sensitive adhesive layer. The polishing pad 32 may have a fifty mil thick hard upper layer and a fifty mil thick softer lower layer. The upper layer may be a polyurethane mixed with fillers. The lower layer may be composed of compressed felt fibers leached with urethane. A common two-layer polishing pad, with the upper layer composed of IC-1000 and the lower layer composed of SUBA-4, is available from Rodel, Inc., located in Newark, Del. (IC-1000 and SUBA-4 are product names of Rodel, Inc.).

Each polishing station 25*a*–25*c* may further include an associated pad conditioner apparatus 40. Each pad conditioner apparatus 40 has a rotatable arm, 42, holding an independently rotating conditioner head 44 and an associated washing basin 46. The conditioner apparatus 40 maintains the condition of the polishing pad so that it will effectively polish any substrate pressed against it while it is rotating.

A slurry 50, containing a reactive agent (e.g., deionized water for oxide polishing), abrasive particles (e.g., silicon dioxide for oxide polishing) and a chemically-reactive catalyzer (e.g., potassium hydroxide for oxide polishing), is supplied to the surface of the polishing pad 32 by a slurry supply port 52 in the center of the platen 30. Sufficient slurry is provided to cover and wet the entire polishing pad 32. Optional intermediate washing stations 55*a,* 55*b* and 55*c* may be positioned between the neighboring polishing stations 25*a,* 25*b* and 25*c* and the transfer station 27. The washing stations are provided to rinse the substrates as they pass from one polishing station to another.

A rotatable multi-head carousel 60 is positioned above the lower machine base 22. The carousel 60 is supported by a center post 62 and rotated thereon about a carousel axis 64 by a carousel motor assembly located within the base 22. The center post 62 supports a carousel support plate 66 and a cover 68. The carousel 60 includes four carrier head assemblies 70*a,* 70*b,* 70*c,* and 70*d*. Three of the carrier head assemblies receive and hold substrates, and polish them by pressing them against the polishing pad 32 on the platen 30 of the polishing stations 25*a*–25*c*. One of the carrier head assemblies receives a substrate from and delivers the substrate to the transfer station 27.

The four carrier head assemblies 70*a*–70*d* are mounted on the carousel support plate 66 at equal angular intervals about the carousel axis 64. The center post 62 allows the carousel motor to rotate the carousel support plate 66 and to orbit the carrier head systems 70*a*–70*d,* and the substrates attached thereto, about the carousel axis 64.

Each carrier head system 70*a*–70*d* includes a carrier head 200, three pneumatic actuators 74 (see FIGS. 2A and 2B), and a carrier motor 76 (shown by the removal of one-quarter of the cover 68 and the pneumatic actuators 74). Each carrier head 200 independently rotates about its own axis, and independently laterally oscillates in a radial slot 72. There are four radial slots 72 in the carousel support plate 66, generally extending radially and oriented 90° apart. Each carrier drive motor 76 is connected to a carrier drive shaft assembly 78 which extends through the radial slot 72 to the carrier head 200. There is one carrier drive shaft assembly and motor for each head.

During actual polishing, three of the carrier heads, e.g., those of carrier head assemblies 70*a*–70*c,* are positioned at and above the respective polishing stations 25*a*–25*c*. The pneumatic actuators lower the carrier head 200 and the substrate attached thereto into contact with the polishing pad 32. A slurry 50 acts as the media for chemical mechanical polishing of the substrate wafer. Generally, the carrier head 200 holds the substrate against the polishing pad and evenly distributes a downward pressure across the back surface of the substrate. The carrier head also transfers torque from the drive shaft assembly 78 to the substrate and ensures that the substrate does not slip from beneath the carrier head during polishing.

Figure 2A:
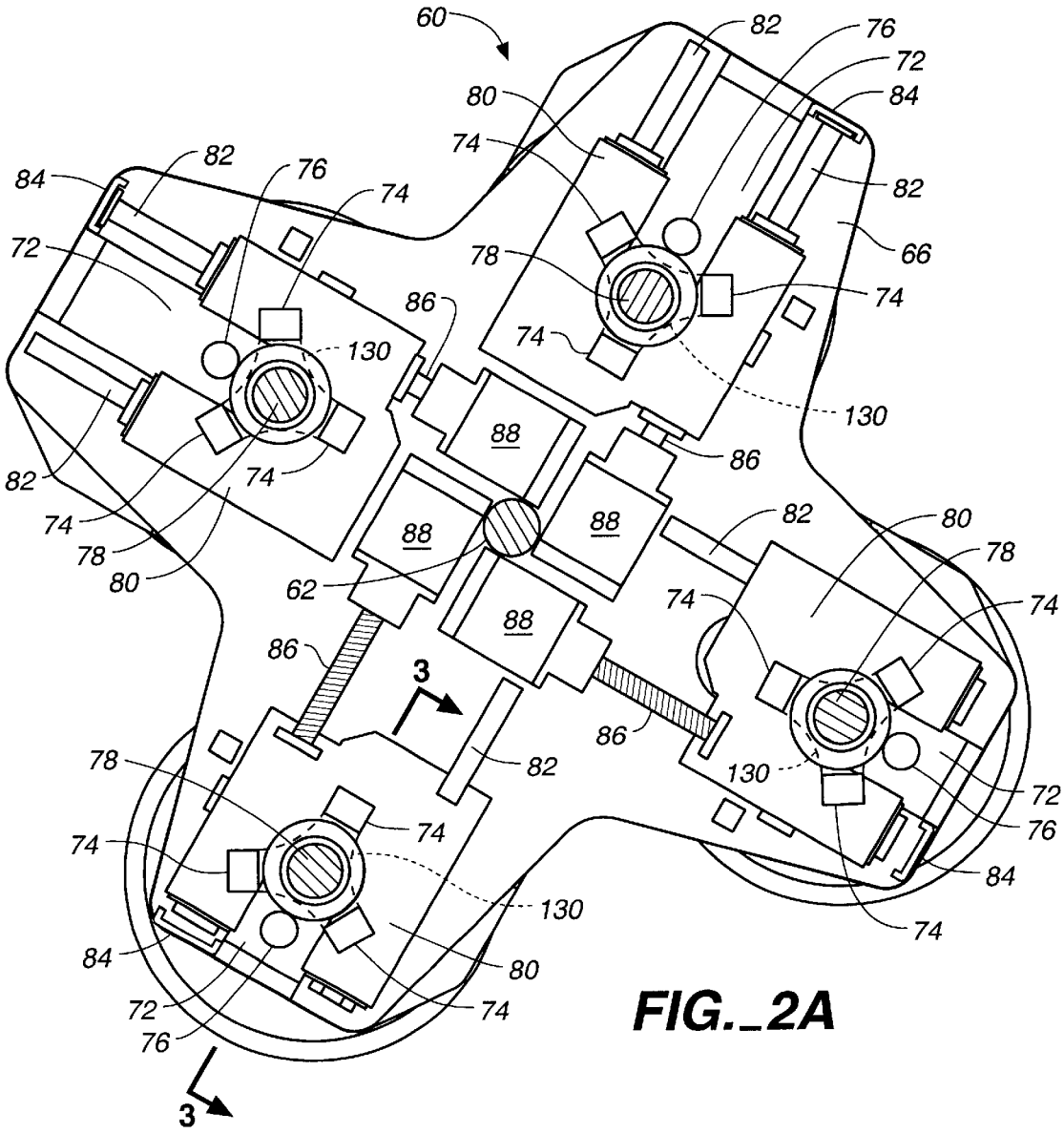
FIG. 2A is a schematic top view of a carousel of FIG. 1, with the upper housing removed.

Referring to FIG. 2A, in which the cover 68 of the carousel 60 has been removed, the carousel support plate 66 supports four support slides 80. Two rails 82 fixed to the carousel support plate 66 bracket each slot 72. Each slide 80 rides on two of the rails 82 to permit the slide 80 to move freely along the associated radial slot 72.

A bearing stop 84 anchored to the outer end of one of the rails 82 prevents the slide 80 from accidentally coming off the end of the rails. Each slide 80 contains an unillustrated threaded receiving cavity or nut fixed to the slide near its distal end. The threaded cavity or nut receives a worm-gear lead screw 86 driven by a slide radial oscillator motor 88 mounted on the carousel support plate 66. When the motor 88 turns the lead screw 86, the slide 80 moves radially. The four motors 88 are independently operable to independently move the four slides 80 along the radial slots 72.

Figure 2B:
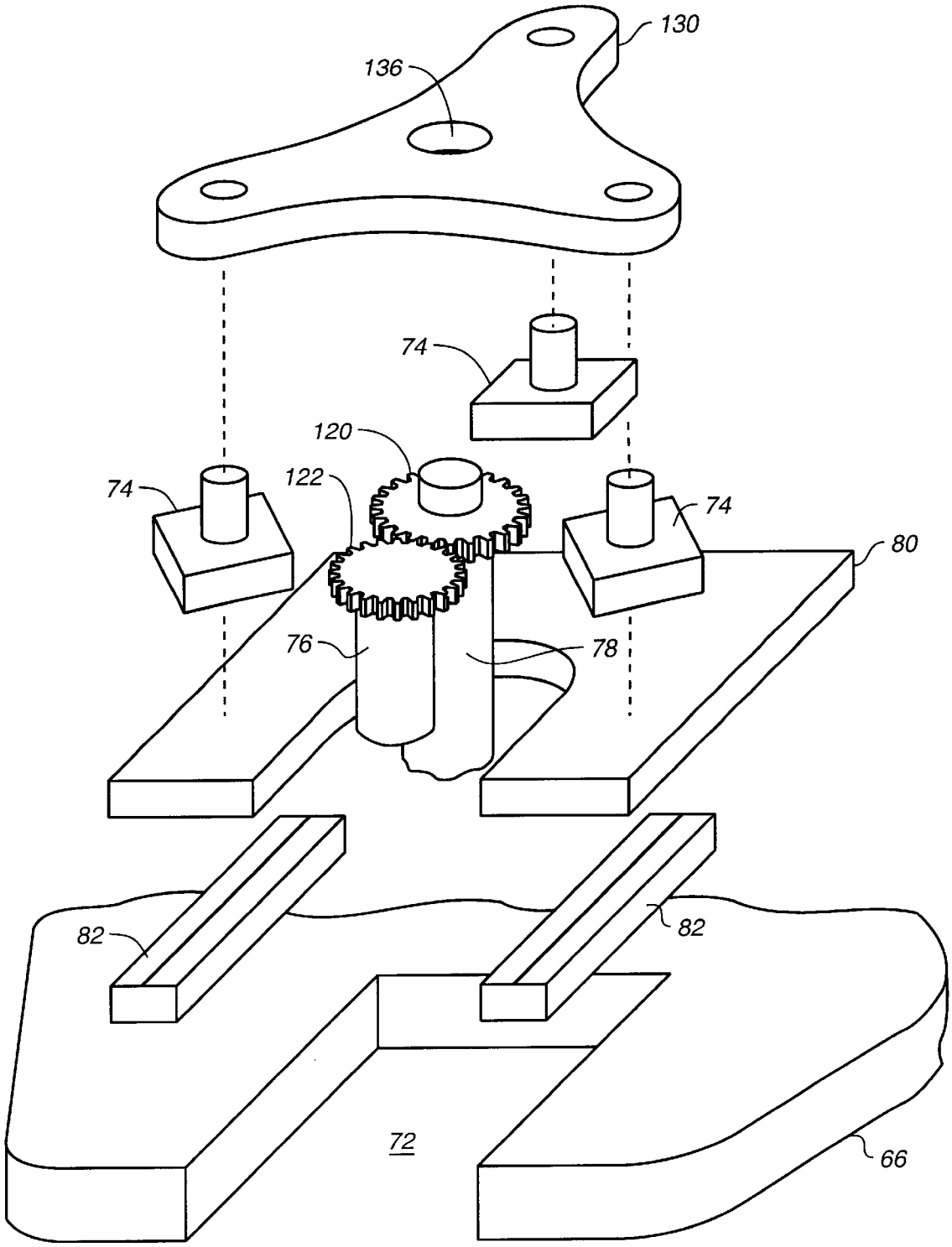
FIG. 2B is a schematic exploded perspective view of a portion of the carrier head assembly located above the carousel support plate.

Referring to FIGS. 2A and 2B, three pneumatic actuators 74 are mounted on each slide 80. The three pneumatic actuators 74 are connected by an arm 130 (shown in phantom in FIG. 2A) to the carrier drive shaft assembly 78. Each pneumatic actuator 74 controls the vertical position of a corner of the arm 130. The pneumatic actuators 74 are connected to a common control system and undergo identical vertical motion so that the arm 130 is maintained in a substantially horizontal position.

Figure 3:
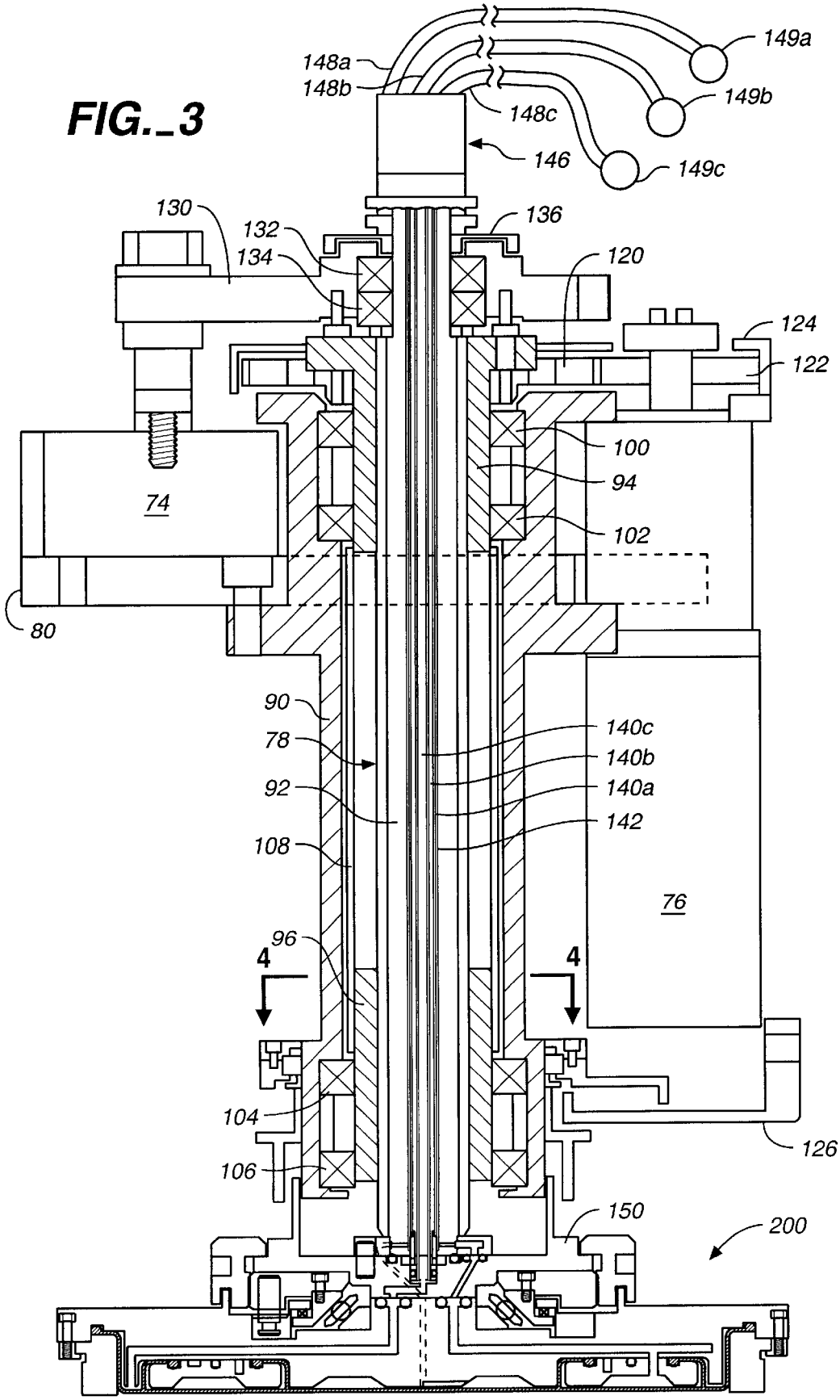
FIG. 3 is partially a cross-sectional view of a carrier head assembly along line 3—3 of FIG. 2A, and a schematical illustration of the pumps used by the CMP apparatus.

Referring to FIG. 3, each carrier head assembly 70*a*–70*d* includes the previously mentioned carrier head 200, pneumatic actuators 74 (only one is shown due to the cross-sectional view), carrier motor 76 and drive shaft assembly 78. The drive shaft assembly 78 includes a spline shaft 92, an upper spline nut 94, a lower spline nut 96, and an adaptor flange 150. Each carrier head assembly 70*a*–70*d* further includes a drive shaft housing 90. The carrier motor 76 may be secured to the drive shaft housing 90, and the pneumatic actuators 74 and the drive shaft housing 90 may be secured to the slide 80. Alternately, the carrier motor 76, the pneumatic actuators 74, and the drive shaft housing 90 may be secured to a carrier support plate (not shown), and the carrier support plate may be attached to the slide 80. The drive shaft housing 90 holds the upper spline nut 94 by means of a pair of upper ball bearings 100, 102. Similarly, the lower spline nut 96 is held by a pair of lower ball bearings 104, 106. The ball bearings permit the spline shaft 92, and the spline nuts 94 and 96 to rotate with respect to the drive shaft housing 90, while holding the spline nuts 96 and 94 in a vertically fixed position. A cylindrical tube 108 may be located between the ball bearings 102 and 104 to connect the upper spline nut 94 to the lower spline nut 96. The spline shaft 92 passes through the spline nuts 94 and 96 to support the carrier head 200. The spline nuts 94 and 96 hold the spline shaft 92 in a laterally fixed position, but allow the spline shaft 92 to slide vertically. The adaptor flange 150 is secured to the lower end of the spline shaft 92. The distance between the upper ball bearings 100, 102 and the lower ball bearings 104, 106 is sufficient to substantially prevent the spline shaft from pivoting under an applied side load from the carrier head. In addition, the ball bearings provide a low-friction rotary coupling. In combination, the ball bearings and the spline shaft help prevent the spline nuts from frictionally "sticking" to the drive shaft housing as a result of the side load.

Figure 4:
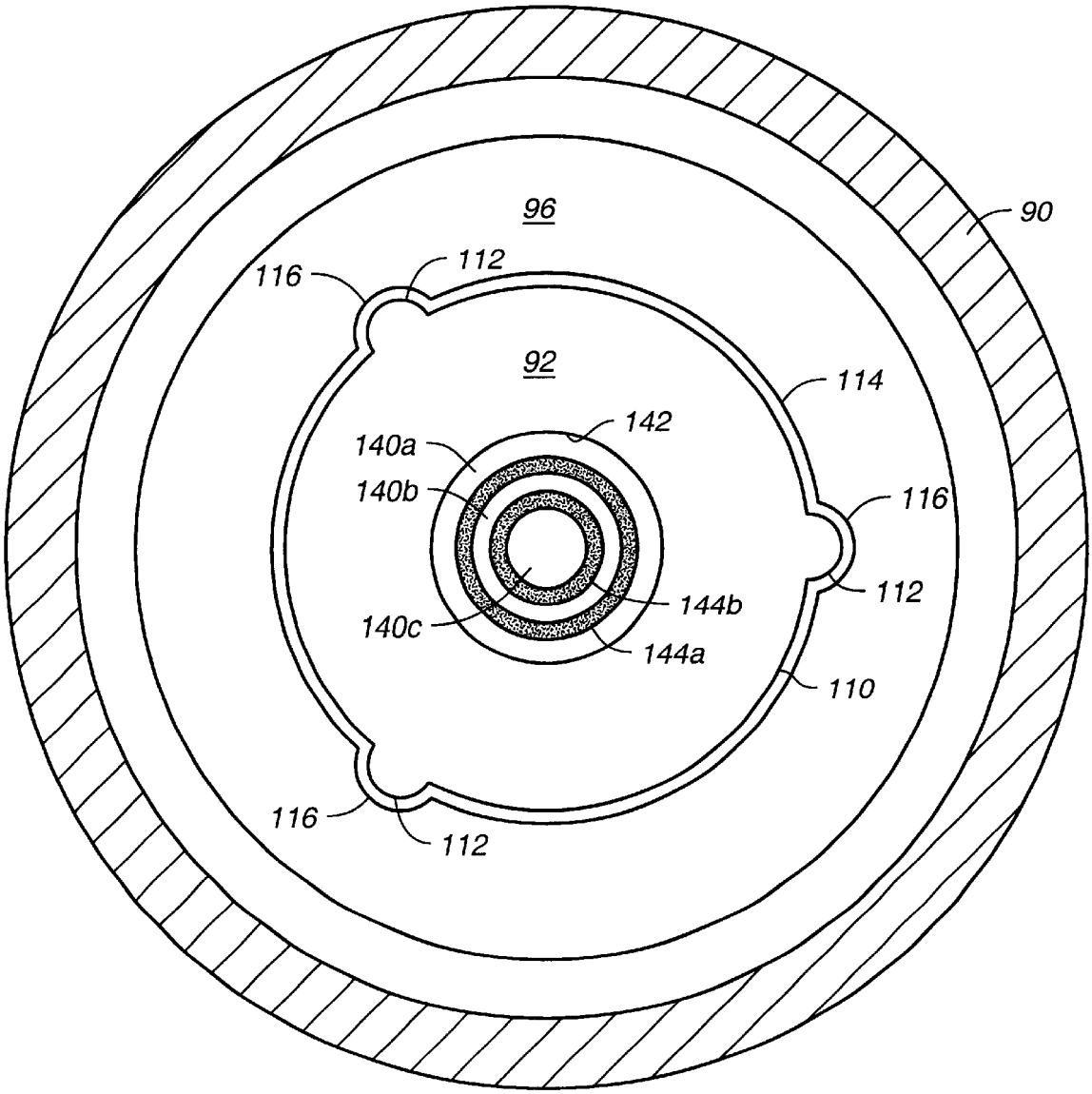
FIG. 4 is a schematic cross-sectional view along line 4—4 of FIG. 3.

Referring to FIG. 4, an outer cylindrical surface 110 of the spline shaft 92 includes three or more projections or tabs 112 which fit into corresponding recesses 116 in an inner cylindrical surface 114 of the spline nut 96. Thus, the spline shaft 92 is rotationally fixed but is free to move vertically relative to the spline nut 96. A suitable spline shaft assembly is available from THK Company, Limited, of Tokyo, Japan.

Returning to FIG. 3, a first gear 120 is connected to a portion of the upper spline nut 94 which projects above the drive shaft housing 90. A second gear 122 is driven by the carrier motor 76 and meshes with the first gear 120. Thus, the carrier motor 76 may drive the second gear 122, which drives the first gear 120, which drives the upper spline nut 94, which in turn drives the spline shaft 92 and the carrier head 200. The gears 120 and 122 may be enclosed by a housing 124 to protect them from slurry or other contaminants from the chemical mechanical polishing apparatus.

The carrier motor 76 may be affixed to the drive shaft housing 90 or to the carrier support plate. The carrier motor 76 may extend through an aperture in the carousel support plate 66 (see FIG. 2B). Advantageously, in order to maximize usage of available space and reduce the size of the polishing apparatus, the carrier motor 76 is positioned adjacent to the drive shaft assembly 78 in the radial slot 72. A splash guard 126 may be connected to the underside of the carousel support plate 66 to prevent slurry from contaminating the carrier motor 76.

The arm 130 is connected to the spline shaft 92. The arm 130 includes a circular aperture 136, and the spline shaft 92 projects above the upper spline nut 94 and through the aperture 136 in the arm 130. The arm 130 holds the spline shaft 92 with an upper ring bearing 132 and a lower ring bearing 134. The inner races of the ring bearings 132 and 134 are secured to the spline shaft 92 and the outer races of the ring bearings are secured to the arm 130. Thus, when the pneumatic actuators 74 lift or lower the arm 130, the spline shaft 92 and the carrier head 200 undergo a similar motion. To load the substrate 10 against the surface of the polishing pad 32, the pneumatic actuators 74 lower the carrier head 200 until the substrate is pressed against the polishing pad. The pneumatic actuators 74 also is control the vertical position of the carrier head 200 so that it may be lifted away from the polishing pad 32 during the transfer of the substrate between the polishing stations 25*a*–25*c* and the transfer station 27.

The substrate is typically subjected to multiple polishing steps, including a main polishing step following a final polishing step. For the main polishing step, usually performed at station 25*a,* the polishing apparatus may apply a force of approximately four to ten pounds per square inch (psi) to the substrate. At subsequent stations, the polishing apparatus may apply more or less force. For example, for a final polishing step, usually performed at station 25*c,* the carrier head 200 may apply a force of about three psi. The carrier motor 76 rotates the carrier head 200 at about 30 to 200 revolutions per minute. The platen 30 and the carrier head 200 may rotate at substantially the same rate.

Referring to FIGS. 3 and 4, a bore 142 is formed through the length of the spline shaft 92. Two cylindrical tubes 144*a* and 144*b* are positioned in the bore 142 to create, for example, three concentric cylindrical channels. As such, the spline shaft 92 may include, for example, an outer channel 140*a,* a middle channel 140*b,* and an inner channel 140*c.* Various struts or cross-pieces (not shown) may be used to hold the tubes 144*a* and 144*b* in place inside the bore 142. A rotary coupling 146 at the top of the spline shaft 92 couples three fluid lines 148*a,* 148*b* and 148*c* to the three channels 140*a,* 140*b* and 140*c,* respectively. Three pumps 149*a,* 149*b* and 149*c* may be connected to the fluid lines 140*a,* 140*b* and 140*c,* respectively. Channels 140*a*–140*c* and pumps 149*a*–149*c* are used, as described in more detail below, to pneumatically power the carrier head 200 and to vacuum chuck the substrate to the bottom of the carrier head 200.

Figure 5:
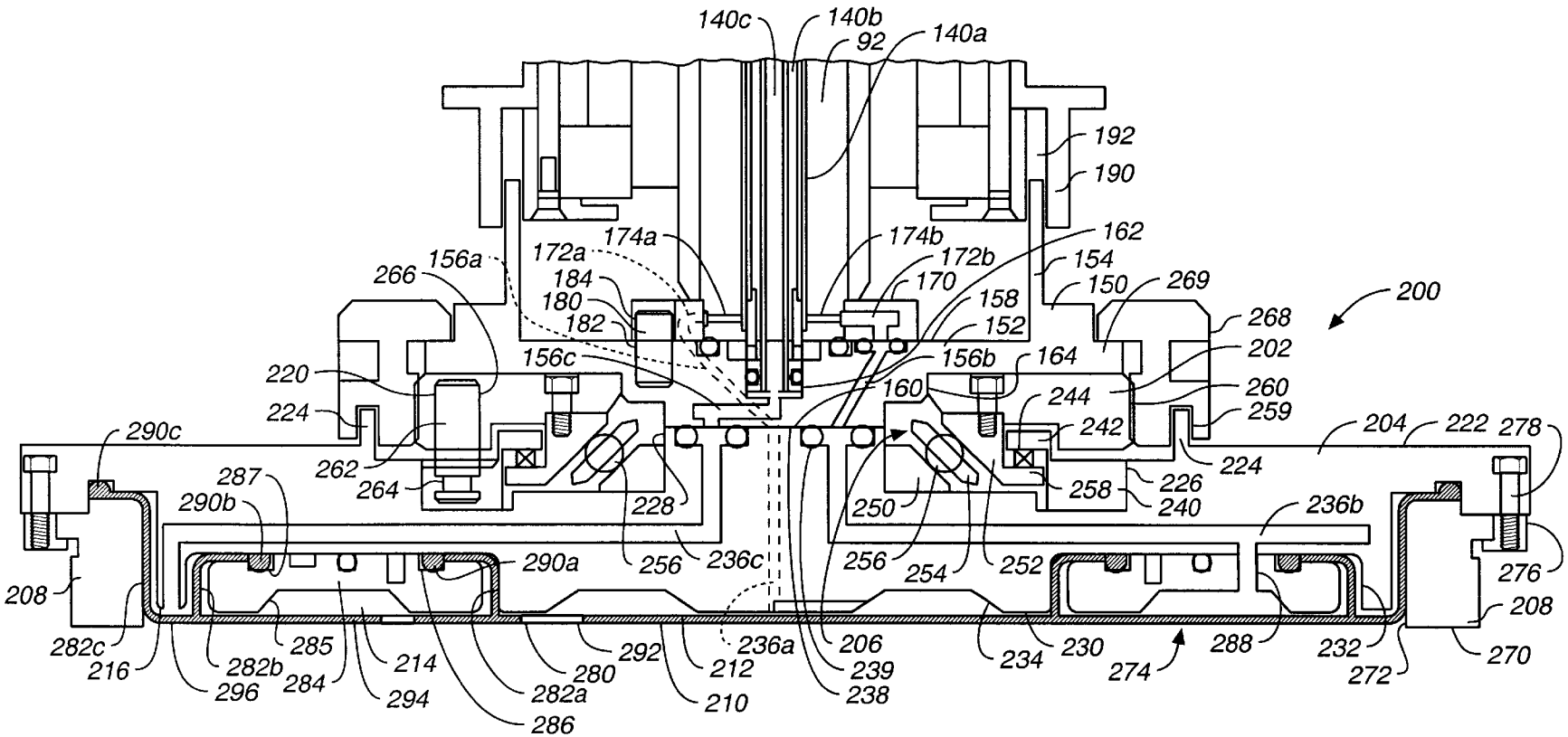
FIG. 5 is an enlarged view of the carrier head of the present invention.

Referring to FIG. 5, the adaptor flange 150 is detachably connected to the bottom of the spline shaft 92. The adaptor flange 150 is a generally bowl-shaped body having a base 152 and a circular wall 154. Three passages 156*a*–156*c* (passage 156*a* is shown in phantom in this cross-sectional view) extend from an upper surface 158 to a lower surface 160 of the base 152 of the adaptor flange 150. The upper surface 158 of the base 152 may include a circular depression 162 and its lower surface 160 may include a lower hub portion 164. The lowermost end of the spline shaft 92 fits into the circular depression 162.

A generally annular connector flange 170 may be joined to the lower portion of the spline shaft 92. The connector flange 170 includes two passages 172*a* and 172*b* (passage 172*b* is shown in phantom in this cross-sectional view). Two horizontal passages 174*a* and 174*b* extend through the spline shaft 92 to connect the channels 140*a* and 140*b* to the passages 172*a* and 172*b*.

To connect the adaptor flange 150 to the spline shaft 92, three dowel pins 180 (only one is shown due to the cross-sectional view) are placed into matching recesses 182 in the upper surface 158 of the adaptor flange 150. Then the adaptor flange 150 is lifted so that the dowel pins 180 fit into matching receiving recesses 184 in the connector flange 170. This circumferentially aligns passages 172*a* and 172*b* with passages 156*a* and 156*b,* respectively, and aligns channel 140*c* with passage 156*c*. The adaptor flange 150 may then be secured to the connector flange 170 with screws (not shown).

The circular wall 154 of adaptor flange 150 prevents slurry from contacting the spline shaft 92. A flange 190 may be connected to the drive shaft housing 90 and the circular wall 154 may project into a gap 192 between the flange 190 and the drive shaft housing 90.

The carrier head 200 includes a housing flange 202, a carrier base 204, a gimbal mechanism 206, a retaining ring 208, and a flexible membrane 210. The housing flange 202 is connected to the adaptor flange 150 at the bottom of the drive shaft assembly 72. The carrier base 204 is pivotally connected to the housing flange 202 by the gimbal mechanism 206. The carrier base 204 is also connected to the adaptor flange 150 to rotate therewith about an axis of rotation which is substantially perpendicular to the surface of the polishing pad 32. The flexible membrane 210 is connected to the carrier base 204 and defines three chambers, including a circular central chamber 212, an annular middle chamber 214 surrounding the central chamber 212, and an annular outer chamber 216 surrounding the annular middle chamber 214. Pressurization of the chambers 212, 214 and 216 controls the downward pressure of the substrate against the polishing pad 32. Each of these elements will be explained in greater detail below.

The housing flange 202 is generally annular in shape and may have approximately the same diameter as the adaptor flange 150. The housing flange 202 includes three vertical passages 220 (only one of which is shown due to the cross-sectional view) formed at equal angular intervals around the axis of rotation of the carrier head 200. The housing flange 202 may have a threaded cylindrical neck 260.

The carrier base 204 is a generally disc-shaped body located beneath the housing flange 202. The diameter of the carrier base 204 is somewhat larger than the diameter of the substrate to be polished. A top surface 222 of the carrier base 204 includes an annular rim 224, an annular recess 226, and a turret 228 located in the center on the recess 226. A bottom surface 230 of the carrier base 204 includes an annular outer depression 232 which will define the edges of the middle chamber 214. The bottom surface 230 of the carrier base 204 also includes a shallower, annular inner depression 234 which will define a cieling of the inner chamber 212.

The carrier base 204 also includes three passageways 236*a*–236*c* (passage 236*a* is shown in phantom in this cross-sectional view) which extend from an upper surface 238 of the turret 228 to the lower surface 230. O-rings 239 are placed into recesses in the upper surface 238 and surround the three passageways 236*a*–236*c* to seal the passageways when the carrier head 200 is connected to the adaptor flange 150.

As previously mentioned, the carrier base 204 is connected to the housing flange 202 by the gimbal mechanism 206. The gimbal mechanism 206 permits the carrier base 204 to pivot with respect to the housing flange 202 so that the carrier base 204 can remain substantially parallel to the surface of the polishing pad. Specifically, the gimbal mechanism permits the carrier base 204 to rotate about a point on the interface between the polishing pad 32 and the substrate 10. However, the gimbal mechanism 206 holds the carrier base 204 beneath the spline shaft 92 to prevent the carrier base 204 from moving laterally, i.e., parallel to the surface of the polishing pad 32. The gimbal mechanism 206 also transfers the downward pressure from the spline shaft 92 to the carrier base 204. Furthermore, the gimbal mechanism 206 can transfer any side load, such as the sheer force created by the friction between the substrate and the polishing pad 32, to the housing flange 202 and drive shaft assembly 78.

An annular biasing flange 240 with an inwardly projecting lip 242 is fixed to the carrier base 204. The biasing flange 240 may be bolted to the carrier base 204 in the annular recess 226.

The gimbal mechanism 206 includes an inner race 250, an outer race 252, a retainer 254, and multiple ball bearings 256. There may be twelve ball bearings 256, although only two are shown in this cross-sectional view. The inner race 250 is secured to or formed as part of the carrier base 204 and is located in the recess 226 adjacent the turret 228. The outer race 252 is secured to or formed as part of the housing flange 202 and includes an outwardly-projecting lip 258 which extends beneath the inwardly-projecting lip 242 of the biasing flange 240. An annular spring washer 244 fits in the gap between the inwardly projecting lip 242 and the outwardly projecting lip 258. The washer 244 biases the inner race 250 and outer race 252 into contact with the ball bearings 256. The retainer 254 is a generally annular-shaped body having a plurality of circular apertures. The ball bearings 256 fit into the apertures in the retainer 254 to be held in place in the gap between the inner race 250 and the outer race 252.

To connect the carrier head 200 to the adaptor flange 150, three vertical torque transfer pins 262 (only one of which is shown in this cross-sectional view) are inserted through the passages 220 in the housing flange 202 and into three receiving recesses 264 in the carrier base 204 or the biasing flange 240. Then the carrier head 200 is lifted so that the vertical torque transfer pins 262 are fitted into three receiving recesses 266 in the adaptor flange 150. This aligns the passages 156*a*–156*c* in the adaptor flange 150 with the passageways 236*a*–236*c*, respectively, in the carrier base 204. A lower hub 178 of the adaptor flange 150 contacts the upper surface 239 of the turret 228. Finally, a threaded perimeter nut 268 can fit over an edge 269 of the adaptor flange 150 and be screwed onto the threaded neck 260 of the housing flange 202 to firmly secure the carrier head 200 to the adaptor flange 150 and thus to the drive shaft assembly 78. The rim 224 of the carrier base 204 may fit into an annular recess 259 in the lower surface of the perimeter nut 268. This creates a restricted pathway that prevents slurry from contaminating the gimbal mechanism 206 or the spring washer 244.

The retaining ring 208 may be secured at the outer edge of the carrier base 204. The retaining ring 208 is a generally annular ring having a substantially flat bottom surface 270. When the pneumatic actuators 74 lower the carrier head 200, the retaining ring 208 contacts the polishing pad 32. An inner surface 272 of the retaining ring 208 defines, in conjunction with the bottom surface of the flexible membrane 210, a substrate receiving recess 274. The retaining ring 208 prevents the substrate from escaping the substrate receiving recess 274 and transfers the lateral load from the substrate to the carrier base 204.

The retaining ring 208 may be made of a hard plastic or ceramic material. The retaining ring 208 may be secured to the carrier base 204 by, for example, a retaining piece 276 which is secured, for example, to the carrier base 204 by bolts 278.

The flexible membrane 210 is connected to and extends beneath the carrier base 204. The bottom surface of the flexible membrane 210 provides a substrate receiving surface 280. In conjunction with the base 204, the flexible membrane 210 defines the central chamber 212, the annular middle chamber 214, and the annular outer chamber 216. The flexible membrane 210 is a generally circular sheet formed of a flexible and elastic material, such as a high strength silicone rubber. The substrate backing membrane 210 includes an inner annular flap 282*a*, a middle annular flap 282*b*, and an outer annular flap 282*c*. The flaps 282*a*–282*c* are generally concentric. The flaps 282*a*–282*c* may be formed by stacking three separate flexible membranes and bonding the central portions of the membranes so as to leave the outer annular portions of each membrane free. Alternatively, the entire flexible membrane 210 may be extruded as a single part.

An annular lower flange 284 may be secured in a depression 232 on the bottom surface 230 of the carrier base 204. The lower flange 284 includes an inner annular groove 286 and an outer annular groove 287 on its upper surface. A passage 288 may extend through the lower flange 284 and connect to passageway 236*b*. The lower flange 284 may also include an annular indentation 289 on its lower surface. The inner flap 282*a*, the middle flap 282*b*, and the outer flap 282*c* may each include a protruding outer edge 290*a*, 290*b* and 290*c*, respectively. To secure the flexible membrane 210 to the carrier base 204, the inner flap 282*a* is wrapped around the inner edge of the lower flange 284 so that its protruding edge 290*a* fits into the inner groove 286, and the middle flap 282*b* is wrapped around the outer edge of the lower flange 284 so that its protruding edge 290*b* fits into the outer groove 287. Then the lower flange 284 is secured in depression 232 by screws (not shown) which may extend from the top surface 222 of the carrier base 204. The inner and middle flaps 282*a* and 282*b* are thus clamped between the lower flange 284 and the carrier base 204 to seal the inner and middle chambers 212 and 214. Finally, the outer edge of 290*c* of outer flap 282*c* is clamped between the retaining ring 208 and the carrier base 204 to seal the outer chamber 216.

Pump 149*a* (see FIG. 3) may be connected to the inner chamber 212 by the fluid line 148*a,* the rotary coupling 146, the inner channel 140a in the spline shaft 92, the passage (not shown) in the adaptor flange 150, and the passageway 236*c* (not shown) through the carrier base 204. Pump 149*b* may be connected to the middle chamber 214 by the fluid line 148*b,* the rotary coupling 146, the middle channel 140*b,* the passage (not shown) in the adaptor flange 150, the passageway 236*b* in the carrier base 204, and the passage 288 in the lower flange 284. Pump 149*c* may be connected to the outer chamber 216 by the fluid line 148*c,* the rotary coupling 146, the outer channel 140*c,* the passage 156*c* in the adaptor flange 150, and the passageway 236*c* in the carrier base 204. If a pump forces a fluid, preferably a gas such as air, into one of the chambers, then the volume of that chamber will increase and a portion of the flexible membrane 210 will be forced downwardly or outwardly. On the other hand, if the pump evacuates a fluid from the chamber, then the volume of the chamber will decrease and a portion of the flexible membrane will be drawn upwardly or inwardly.

Figure 6:
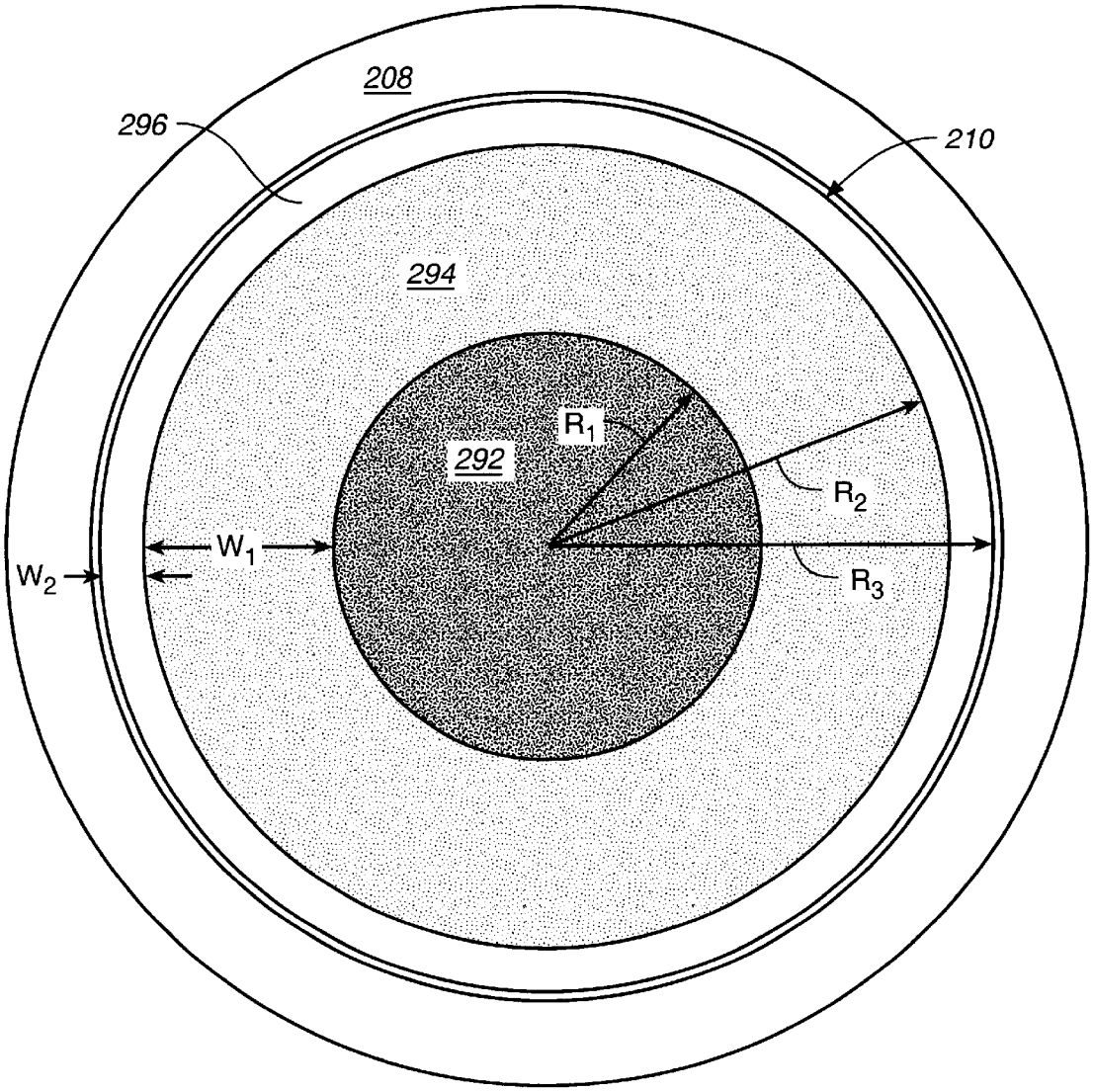
FIG. 6 is a schematic bottom view of the carrier head of the present invention.

The flexible membrane 210 may include a circular inner portion 292, an annular middle portion 294, and an annular outer portion 296 located beneath the inner chamber 212, middle chamber 214, and outer chamber 216, respectively (see also FIG. 6). As such, the pressures in chambers 212, 214 and 216 can control the downward pressure applied by the respective flexible membrane portions 292, 294 and 296.

The flexible membrane portions may have different dimensions. The majority of the edge effect occurs at the outer-most six to eight millimeters of the substrate. Therefore, the annular outer membrane portion 296 may be fairly narrow in the radial direction in comparison to the annular middle membrane portion 294 in order to provide pressure control of a narrow edge region at the edge of the substrate which is independent of the pressures applied to the center and middle portions of the substrate.

Referring to FIG. 6, the inner membrane portion 292 may have a radius $R_1$, the middle membrane portion 294 may have an outer radius $R_2$, and the outer membrane portion 296 may have an outer radius $R_3$. The width $W_1$ of the middle membrane portion 294 may be equal to $R_2$–$R_1$, and width $W_2$ of the outer membrane portion 296 may be equal to $R_3$–$R_2$. The radius $R_3$ may be equal to or greater than about 100 mm (for a 200 mm diameter substrate), and the width $W_2$ may be between five and thirty millimeters. If the radius $R_3$ is 5.875 inches (for a 300 mm diameter substrate), the widths $W_1$ and $W_2$ may be 2.375 inches and 0.625 inches, respectively. In this configuration, the radii $R_1$ and $R_2$ are 2.875 and 5.25 inches, respectively.

The pressures in chambers 212, 214 and 216 may be independently controlled by pumps 149*a,* 149*b* and 149*c* to maximize the uniformity of polishing of the substrate 10. The average pressure in outer chamber 216 may be lower than the average pressure in the other two chambers so that the pressure on the outer annular membrane portion 296 is lower than the pressure on the inner membrane portion 292 or the middle membrane portion 294 during polishing so as to compensate for the over-polishing created by the edge effect.

The flexible membrane 210 deforms to match the backside of the substrate 10. For example, if the substrate is warped, the flexible membrane 210, will in effect, conform to the contours of the warped substrate. Thus, the load on the substrate should remain uniform even if there are surface irregularities on the back side of the substrate.

Rather than applying a different pressure to each chamber, the time during which a positive pressure is applied to each chamber may be varied. In this fashion, uniform polishing may be achieved. For example, rather than apply a pressure of 8.0 psi to the inner chamber 212 and the middle chamber 214 and a pressure of 6.0 psi to the outer chamber 216, a pressure of 8.0 psi may be applied to the inner chamber 212 and the middle chamber 214 for one minute while the same pressure is applied to the outer chamber 216 for forty-five seconds. This technique permits pressure sensors and pressure regulators to be replaced by simple software timing controls. In addition, the technique may allow for a more accurate process characterization and consequently better uniformity in polishing the substrate.

The carrier head 200 can vacuum-chuck the substrate 10 to the underside of the flexible membrane 210. As such, pressure in the middle chamber 214 is reduced as compared to the pressure in the other chambers and this causes the middle membrane portion 294 of the flexible membrane 210 to bow inwardly. The upward deflection of the middle membrane portion 294 creates a low pressure pocket between the flexible membrane 210 and the substrate 10. This low pressure pocket will vacuum-chuck the substrate 10 the carrier head. It is advantageous to use the middle membrane portion 294 as opposed to the inner membrane portion 292 in order to avoid bowing the center of the substrate, which can create a low pressure pocket between the substrate and the polishing pad. Such a low pressure a pocket would tend to vacuum-chuck the substrate to the polishing pad. In addition, the pressure in the outer chamber 216 may be increased while the pressure in the middle chamber 214 is reduced. An increased pressure in the outer chamber 216 forces the outer membrane portion 296 against the substrate 10 to effectively form a fluid-tight seal. This seal can prevent ambient air from entering the vacuum between the middle membrane portion 294 and the substrate. The outer chamber 216 may be pressurized for only a short period of time, for example, less than a second, while the vacuum pocket is being created, as this appears to provide the most reliable vacuum-chucking procedure.

The polishing apparatus 20 may operate as follows. The substrate 10 is loaded into the substrate receiving recess 274 with the backside of the substrate abutting the flexible membrane 210. The pump 149*a* pumps fluid into the outer chamber 216. This causes the outer membrane portion 296 to form a fluid-tight seal at the edge of the substrate 10. Simultaneously, pump 149*b* pumps fluid out of the middle chamber 214 to create a low pressure pocket between the membrane 210 and the backside of the substrate 10. The outer chamber 216 is then quickly returned to normal atmospheric pressure. Finally, the pneumatic actuators 74 lift the carrier head 200 off of the polishing pad 32 or out of the transfer station 27. The carousel 60 rotates the carrier head 200 to a new polishing station. The pneumatic actuators 74 then lower the carrier head 200 until the substrate 10 contacts the polishing pad 32. Finally, the pumps 149*a*–149*c* force fluid into the chambers 212, 214 and 216 to apply a downward load to the substrate 10 for polishing.

The present invention is described in terms of the preferred embodiment. The invention, however, is not limited to the embodiments depicted and described herein. Rather, the scope of the invention is defined by the appended claims.

What is claimed is:

1. A carrier head, comprising:

a frame;

a flexible membrane connected to the frame, a lower surface of the flexible membrane providing a substrate receiving surface with an inner portion, a middle portion surrounding the inner portion, and an outer portion surrounding the middle portion and having a width less than a width of the middle portion; and a plurality of independently pressurizable chambers between the frame and the flexible membrane including a first chamber, a second chamber and a third chamber formed between the frame and the flexible membrane, a first pressure in the first chamber generating a load on the inner portion, a second pressure in the second chamber generating a load on the middle portion, and a third pressure in the third chamber generating a load on the outer portion.

2. The carrier head of claim 1, wherein the outer portion has an outer radius approximately equal to or greater than 100, millimeters and the width of the outer portion is between about 4 and 20 millimeters.

3. The carrier head of claim 2, wherein the width of the outer portion of the flexible membrane is about 10 millimeters.

4. The carrier head of claim 1, wherein the flexible membrane includes an inner annular flap, a middle annular flap, and an outer annular flap, each flap being secured to a lower surface of the frame to define the first, second and third chambers.

5. The carrier head of claim 1, further comprising a housing attachable to a drive shaft and a gimbal pivotally connecting the housing to the frame.

6. The carrier head of claim 5, wherein the gimbal includes an inner race connected to the frame, an outer race connected to the housing to define a gap therebetween, and a plurality of bearings located in the gap.

7. The carrier head of claim 1, further comprising a retaining ring connected to the frame to define, in conjunction with the flexible membrane, a substrate receiving recess.

8. The carrier head of claim 7, wherein the retaining ring has a fixed position relative to the frame.

9. A carrier head, comprising:

a frame:

a flexible inner membrane portion positioned below the frame and associated with a first chamber to apply a first pressure to a central portion of a substrate;

a substantially annular flexible middle membrane portion positioned below the frame and associated with a second chamber and surrounding the inner membrane portion to apply a second pressure to a middle portion of the substrate; and a substantially annular flexible outer membrane portion positioned below the frame and associated with a third chamber and surrounding the middle membrane portion to apply a third pressure to an outer portion of the substrate, wherein the outer membrane portion is substantially narrower than the middle membrane portion, and wherein the first, second and third chambers are independently pressurizable so that pressures on each of the inner, middle and outer membrane portions are independently controllable.

10. The carrier head of claim 9, wherein the inner membrane portion, the middle membrane portion, and the outer membrane portion are portions of a single flexible membrane.

11. The carrier head of claim 10, wherein the flexible membrane includes an inner annular flap, a middle annular flap, and an outer annular flap, each flap being secured to a lower surface of the frame to define the first, second and third chambers.

12. The carrier head of claim 9, wherein the outer membrane portion has an outer radius approximately equal to or greater than 100 millimeters and the width of the outer membrane portion is between about 4 and 20 millimeters.

13. The carrier head of claim 12, wherein the width of the outer membrane portion is about 10 millimeters.

14. A method of chemical mechanical polishing, comprising:

loading a substrate in a carrier head;

pressurizing a first chamber in the carrier head located between a frame and a flexible inner membrane portion to apply a first pressure to a central portion of the substrate through the flexible inner membrane portion;

pressurizing a second chamber in the carrier head between the frame and a flexible middle membrane portion to apply a second pressure to a middle portion of the substrate through the flexible middle portion; and pressurizing a third chamber in the carrier head between the frame and a flexible outer membrane portion to apply a third pressure to an outer portion of the substrate through the flexible outer membrane portion, wherein the outer membrane is narrower than the middle membrane portion.

15. The method of claim 14 wherein the inner membrane portion, the middle membrane portion, and the outer membrane portion are portions of a single flexible membrane.

* * * * *